US006568144B2

(12) United States Patent
Meredith

(10) Patent No.: US 6,568,144 B2
(45) Date of Patent: May 27, 2003

(54) METAL CONSTRUCTION PANEL

(76) Inventor: Harold F. Meredith, 10 Duncan Street East, Huntsville, Ontario (CA), P1H 1P6

( * ) Notice: Subject to any disclaimer, the term of this patent is extended or adjusted under 35 U.S.C. 154(b) by 0 days.

(21) Appl. No.: 09/973,829

(22) Filed: Oct. 11, 2001

(65) Prior Publication Data

US 2002/0043039 A1 Apr. 18, 2002

Related U.S. Application Data

(60) Provisional application No. 60/240,847, filed on Oct. 17, 2000.

(51) Int. Cl.[7] ..... E04B 1/40

(52) U.S. Cl. ..... 52/656.1; 52/745; 52/748; 52/478; 52/300; 52/627; 52/584; 52/588.1; 52/590.2

(58) Field of Search ..... 52/79.1, 347, 36.1, 52/798.1, 801.11, 656.1, 582.1, 586.1, 586.2, 585.1, 590.2, 590.3, 592.1, 592.4, 404.1, 762, 483.1, 588.1

(56) References Cited

U.S. PATENT DOCUMENTS 2,867,857 A * 1/1959 McCarthy ..... 20/15
3,568,388 A * 3/1971 Flachbarth et al. ..... 52/241
3,583,123 A * 6/1971 Holmgren et al. ..... 428/167
3,633,327 A * 1/1972 Klingensmith et al. ..... 52/241
3,967,430 A * 7/1976 Knudson ..... 29/243.5
4,406,106 A * 9/1983 Dinges ..... 428/63
6,415,557 B1 * 7/2002 McCalley ..... 109/1 S

* cited by examiner

*Primary Examiner*—Carl D. Friedman
*Assistant Examiner*—Basil Katcheves

(57) ABSTRACT

The present invention an elongated metal construction panel for use in forming a portion of the vertical walls of a building structure by being fastened to an identical adjacent panel, the metal construction panel comprising a front portion co-extensive with the length of the panel; end plates co-extensive with the length of the panel disposed substantially normal to said front portion and extending from distal ends of said front portion, said end plates defining the depth of said panel; flanges co-extensive with the length of the panel and extending inwardly from distal ends of said end plate, wherein said flanges are spaced from and parallel to said front portion; and wherein said end plates include end troughs co-extensive with the length of the panel such that when metal construction panels are placed adjacent each other by bringing into contact said end plates, said end troughs form a bonding channel adapted and sized for pouring bonding agents therein thereby securely fastening adjacent panels together and also waterproofing the joint between said end plates.

18 Claims, 12 Drawing Sheets

METAL CONSTRUCTION PANEL

This application claims priority from previously regularly filed U.S. Provisional Application filed on Oct. 17, 2000 under Application Ser. No. 60/240,847, by Harold Meredith having the title METAL CONSTRUCTION PANEL.

FIELD OF THE INVENTION

The invention relates to pre-engineered metal building systems and more specifically to an improved metal construction panel for use in forming the exterior wall of buildings.

BACKGROUND OF THE INVENTION

Currently in North America and Canada, the traditional method for building residential and some commercial buildings is wood framing, on top of a concrete foundation, after which the framing is either clad with brick or siding. With the disappearance of many of the best forests in North America, the lack of good lumber has driven up wood prices and therefore constructing homes using conventional wood framing technics is slowly becoming prohibitably too expensive.

A number of metal building systems are on the market including replacement of existing 2×4 and 2×6 wood studding and members with metal counter parts which are installed in a similar manner as the wood they are replacing. The disadvantage of this system is that the traditional framing and cladding process must occur, thereby there is little savings in regard to labour costs.

A number of other inventions have tried to address this problem by providing for a metal panel which provides both structural strength as well as exterior cladding for a building. Such building panels and methods of construction are described in U.S. Pat. No. 1,883,141 by Walters issued Oct. 18, 1932 titled Building Construction.

U.S. Pat. No. 2,023,814 titled: Metal Building Construction, issued on Dec. 10, 1935 to Samuel Lindsay and finally U.S. Pat. No. 3,568,388 titled Building Panel, filed by Charles T. Flachfbarth and Robert L. Parsons issued on Mar. 9, 1971. These patents describe building construction methods using a metal panel which serves both as a structural panel as well as an exterior architectural finished surface. By using these panels in one step, both framing and cladding of the house is completed. The advantage of the systems that they describe are the potentially reduced labour costs by eliminating one step in the building construction phase and in addition to that the improved strength of the house as well as the fire resistance and other safety features not found in wood constructed homes.

The disadvantage with these building systems is that they fail to address the problems of sealing off the joints in between the panels, thereby preventing water from seeping into the house due to capillary action. Secondly, the lack of flexibility in regard to choosing the exterior look. The user of such panels cannot choose alternate exterior cladding looks other than the one provided by the panels themselves.

SUMMARY OF THE INVENTION

The present invention an elongated metal construction panel for use in forming a portion of the vertical walls of a building structure by being fastened to an identical adjacent panel, the metal construction panel comprises:

(a) a front portion co-extensive with the length of the panel;

(b) end plates co-extensive with the length of the panel disposed substantially normal to said front portion and extending from distal ends of said front portion, said end plates defining the depth of said panel;

(c) flanges co-extensive with the length of the panel and extending inwardly from distal ends of said end plate, wherein said flanges are spaced from and parallel to said front portion; and (d) wherein said end plates include end troughs co-extensive with the length of the panel such that when metal construction panels are placed adjacent each other by bringing into contact said end plates, said end troughs form a bonding channel adapted and sized for pouring bonding agents therein thereby securely fastening adjacent panels together and also waterproofing the joint between said end plates.

Preferably wherein said end troughs including a fluted section having a U shaped profile being co-extensive with the length of the panel.

Preferably wherein the width of said front portion is at least 3 times the depth of said end plate.

Preferably the width of said front portion is preferably 4 times the depth of said end plate.

Preferably wherein the depth of said end plate being at least 3½ inches.

Preferably wherein the front portion includes female dovetail grooves co-extensive with the length of the panel and adapted to co-operate with an attachment clip for fastening articles to said attachment clip.

Preferably wherein said dovetail grooves define fluted surfaces disposed at an angle theta less than 90°.

Preferably wherein said angle theta is preferably 87°.

Preferably wherein said attachment clip defines male dovetail tabs cooperating with said female dovetail grooves to hold said clip within said dovetail grooves, whereby said tabs are joined together in spaced apart relationship by a joining member.

Preferably wherein said tabs are resiliently biased such that said tabs are compressed for placing said tabs within said female dovetail grooves and upon release said resiliently biased tabs hold said attachment clip within said female dovetail grooves.

Preferably wherein said attachment clip further comprises wings extending from said tabs and oriented substantially parallel and adjacent to said front portion for securely fastening said clip to said panel.

Preferably wherein said attachment clip further comprises an attachment lip rigidly connected to said joining member for fastening articles thereto.

Preferably wherein said attachment lip is adapted for fastening vinyl siding thereto.

BRIEF DESCRIPTION OF THE DRAWINGS

The invention will now be described by way of example only, with references to the followings drawings in which.

DETAILED DESCRIPTION OF THE PREFERRED EMBODIMENT

Figure 1:
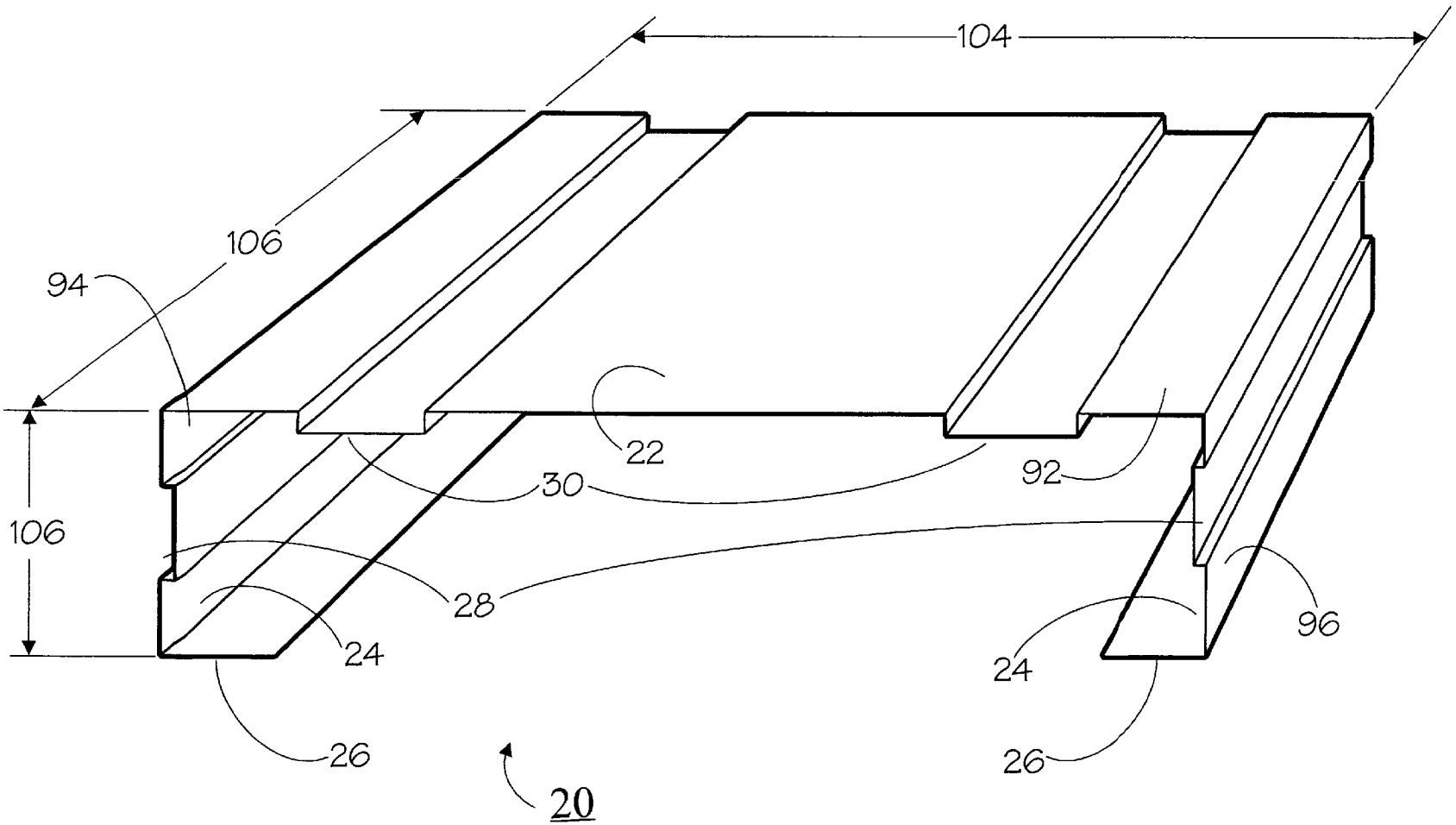
FIG. 1 is a schematic top perspective view of the metal construction panel.

Referring first of all to FIG. 1 which schematically shows a metal construction panel showing generally as 20 having a front 22, end plates 24, flanges 26, end troughs 28, and dovetail grooves 30. Front 22 of panel 20 has length 102, width 104 and end plates 24 have depth 106. The panel is oriented vertically along longitudinal axis 90. Front 22 has front first end 92 and front second end 94. End plates 24 include end plate distal end 96.

Figure 2:
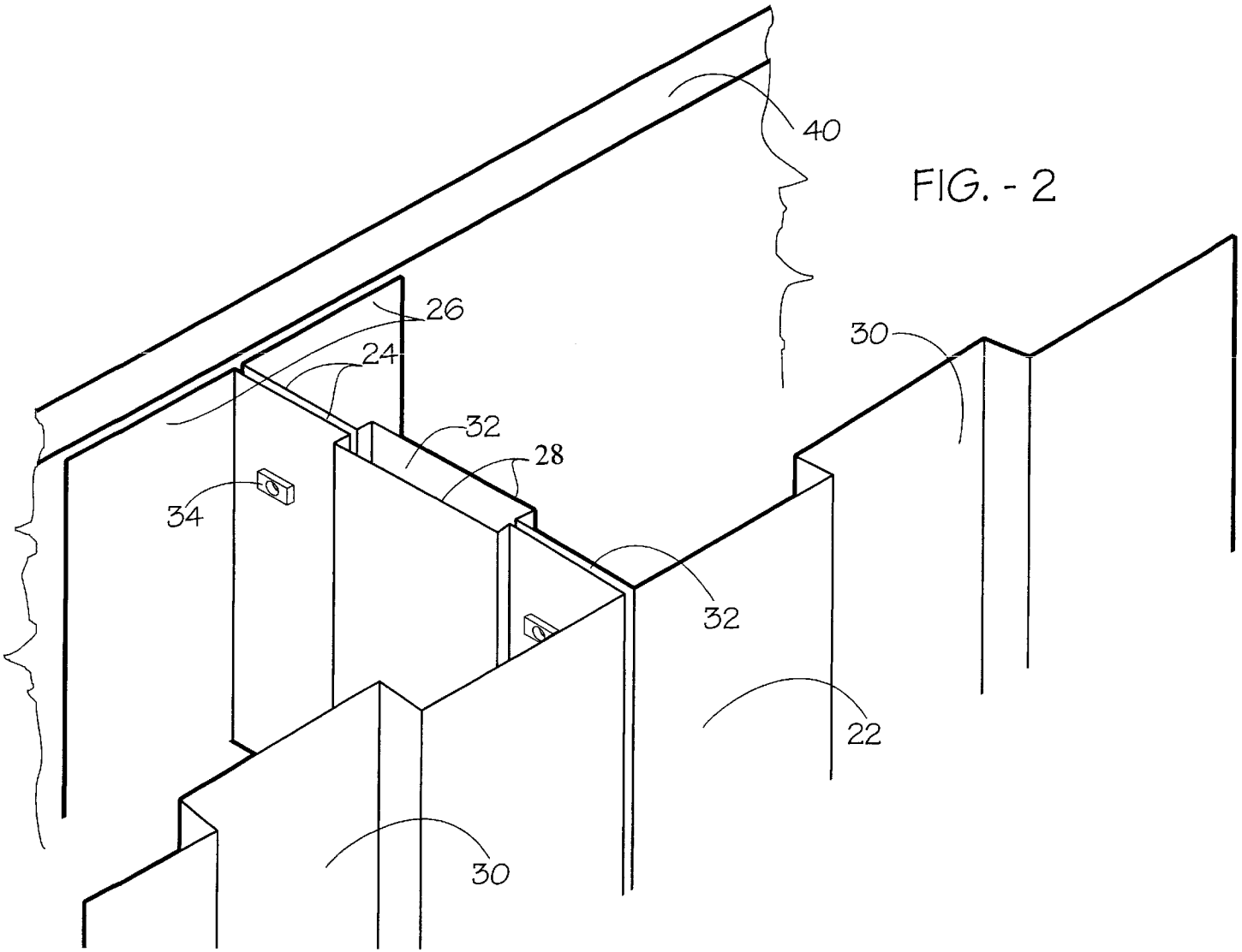
FIG. 2 is a partial cut away schematic showing the installation and joining of two metal construction panels together with drywall.

Referring now to FIG. 2 which schematically illustrates the joining of two end plates 24 of metal construction panels 20. Metal construction panels 20 are joined together when end plates 24 come in contact with each other, such that end troughs 28 form a bonding channel 32 which is a rectangular tubular section running longitudinally along the length of metal construction panel 20. The tubular section can take on any number of shapes other than shown here. Metal construction panels 20 can be mechanically fastened together using fastener attachments 32 which could for example be a nut and bolt arrangement mechanically connecting end plates 24 together. Preferably, however in order to seal off the joint formed by joining end plates 24 together, a bonding material is poured into bonding channel 32 thereby sealing off the groove or joint formed between end plates 24 therefore preventing water from entering from front 22 of metal construction panels 20 via capillary action and into the interior of the home.

From FIG. 2, one can see that front 22 forms the exterior architectural portion of the home, whereas flanges 26 serve as fastening attachments for screwing or nailing wallboard 40 onto flanges 26. Wallboard 40 can be the conventional drywall sheets which are used in conventional home construction now and/or can be another type of interior surfacing which is suitable. Panel 20 preferably is fabricated from sheet steel or aluminum and is preferably fabricated using the roll forming process.

Figure 3:
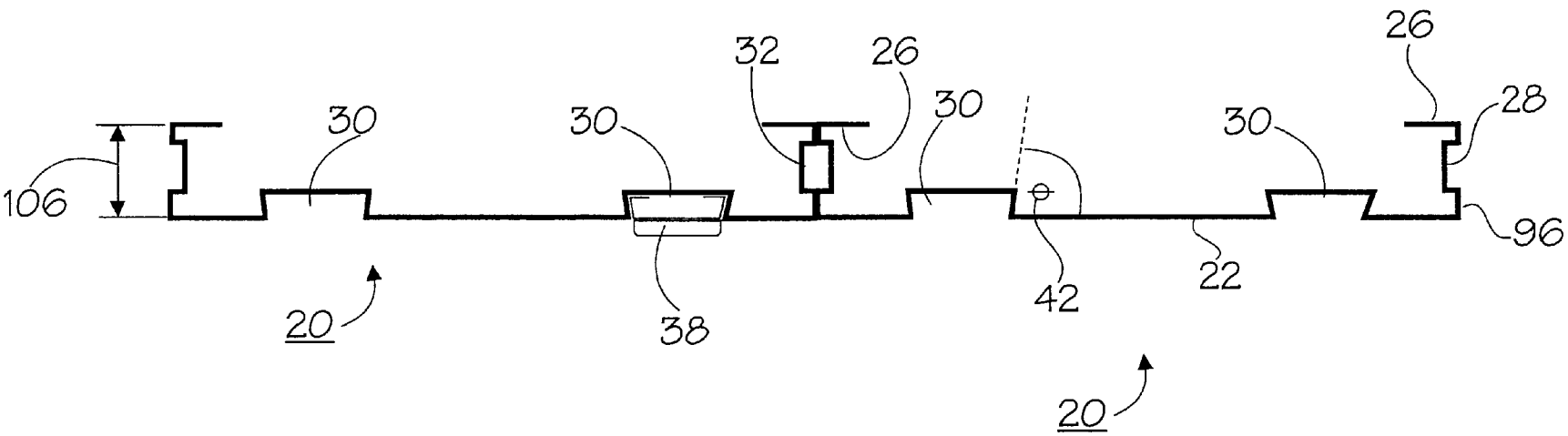
FIG. 3 is a top cross sectional view of two metal construction panels joined together showing a clip attached to one panel.

Referring now to FIG. 3 showing in cross section two metal construction panels 20 joined together, and in particular dovetail grooves 30 are shown having an angle theta 42 of approximately 87 degrees. Further attachment clip 38 is shown in situ in dovetail groove 30 indicating how attachment clip 38 is mounted to a metal construction panel 20. In this view, also one can see how bonding channel 32 is formed by adjacent end troughs 28 when end plates 24 are brought together.

Figure 4:
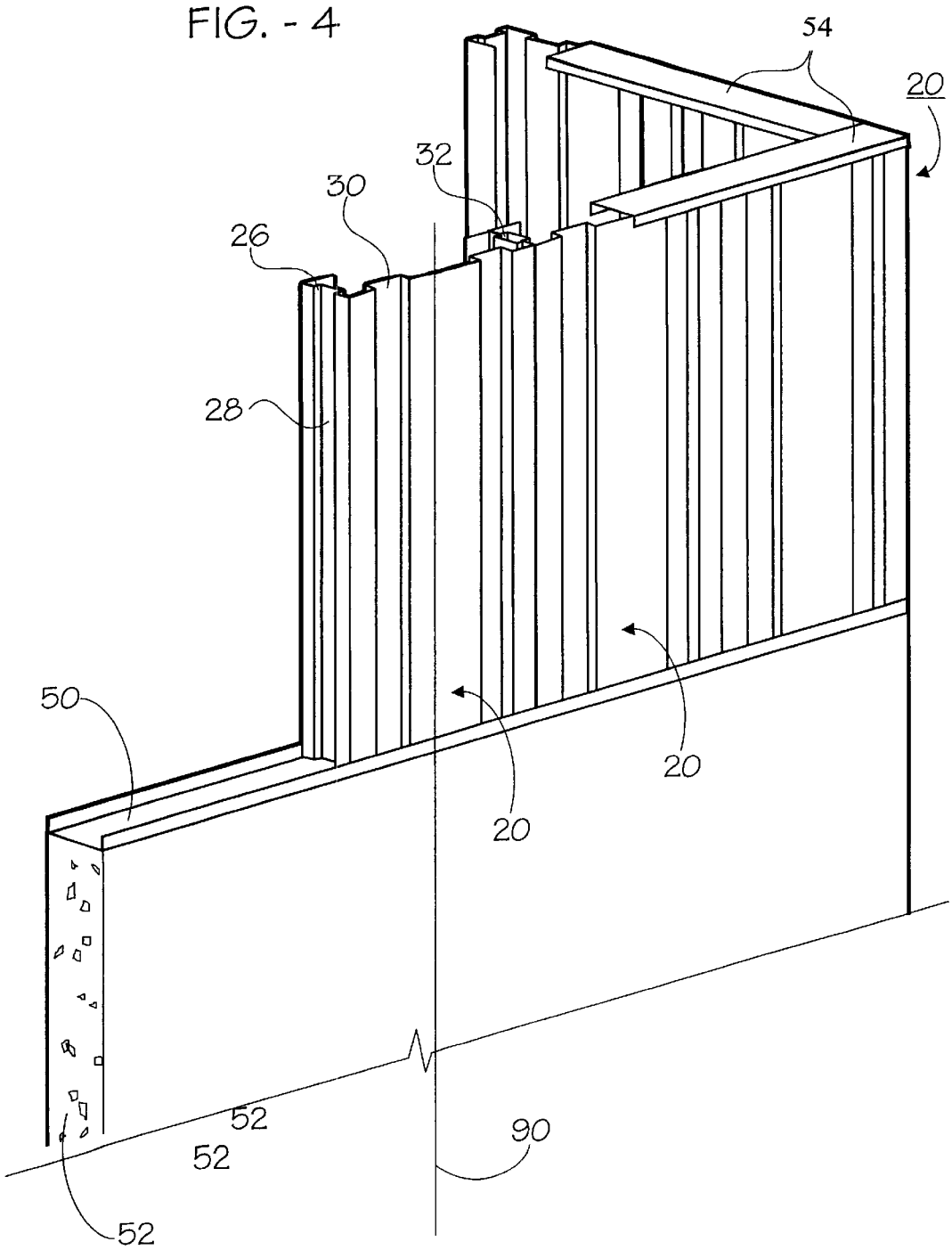
FIG. 4 is a schematic perspective assembly view of metal construction panels upon a foundation illustrating how the metal construction panels would be joined together.

Referring now to FIG. 4, a number of metal construction panels 20 are shown in schematic fashion mounted together onto a foundation 52. Typically on top of a concrete foundation 52, a foundation channel 50 would be mounted into place and there upon metal construction panels 20 would be fastened such that they extend vertically upward from foundation 52, along longitudinal axis 90. Those skilled in the art will see that metal construction panel 20 serves not only as a structural wall member but also as an exterior architectural panel for the building construction. Metal construction panels 20 are joined at end plates 24 either adhesively by pouring adhesive into bonding channel 32 and/or including mechanical fastening attachments 34 shown in FIG. 2. It is apparent that front 22 of metal construction panels 20 is disposed outwardly creating the exterior cladding of the building. In addition, dovetail grooves 30 extend vertically along metal construction panels 20 for accommodating attachment clips 38 as will be explained here below. Typically once metal construction panels 20 have been erected onto foundation channel 50, a top plate 54 is mounted and fastened to the top portion of metal construction panels 20 which can be used for subsequent erection of the roof truss sections or other roof construction.

Attachment Clip

Figure 5:
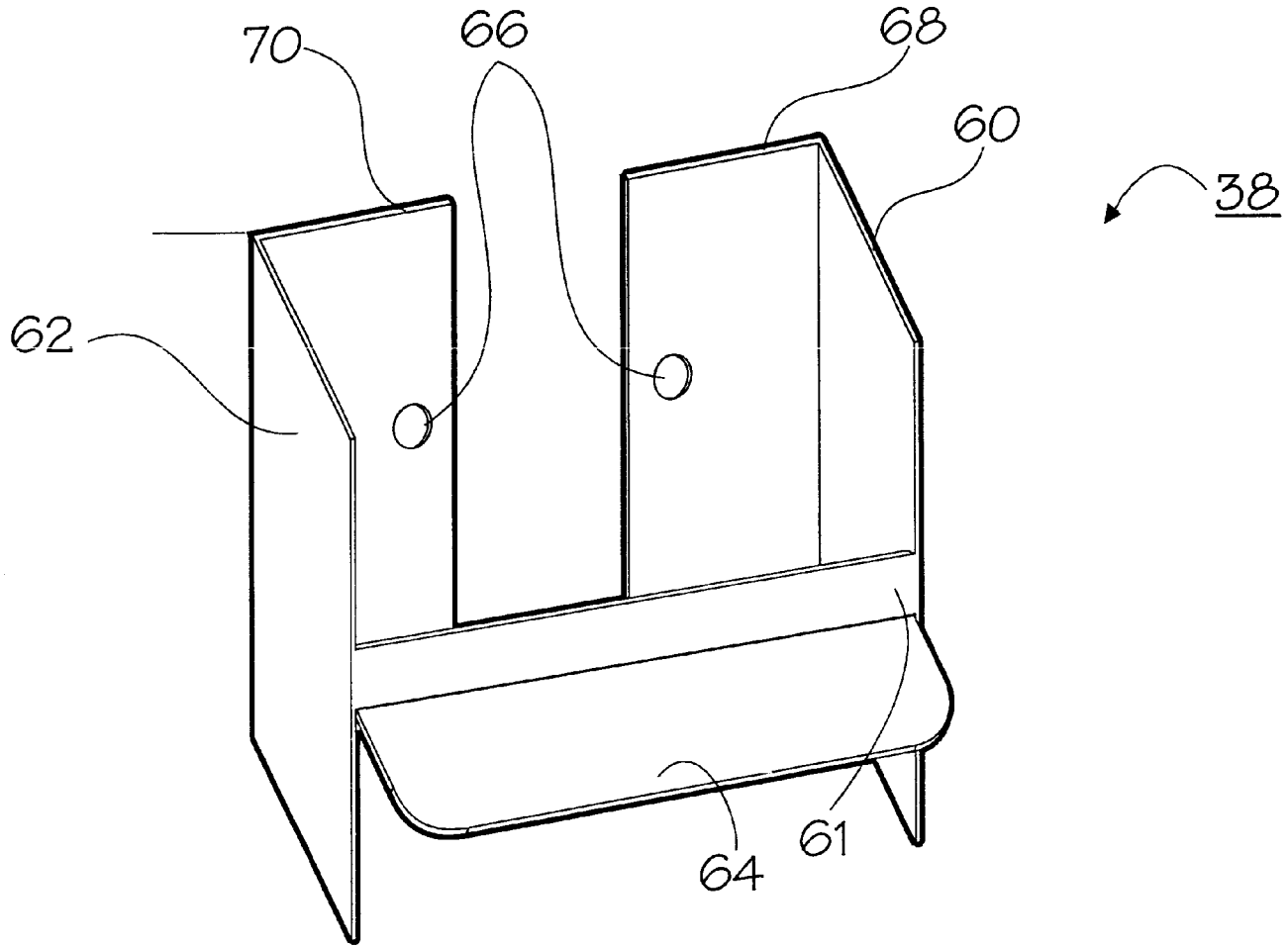
FIG. 5 is a front perspective view of an attachment clip for use with the metal construction panel.
Figure 6:
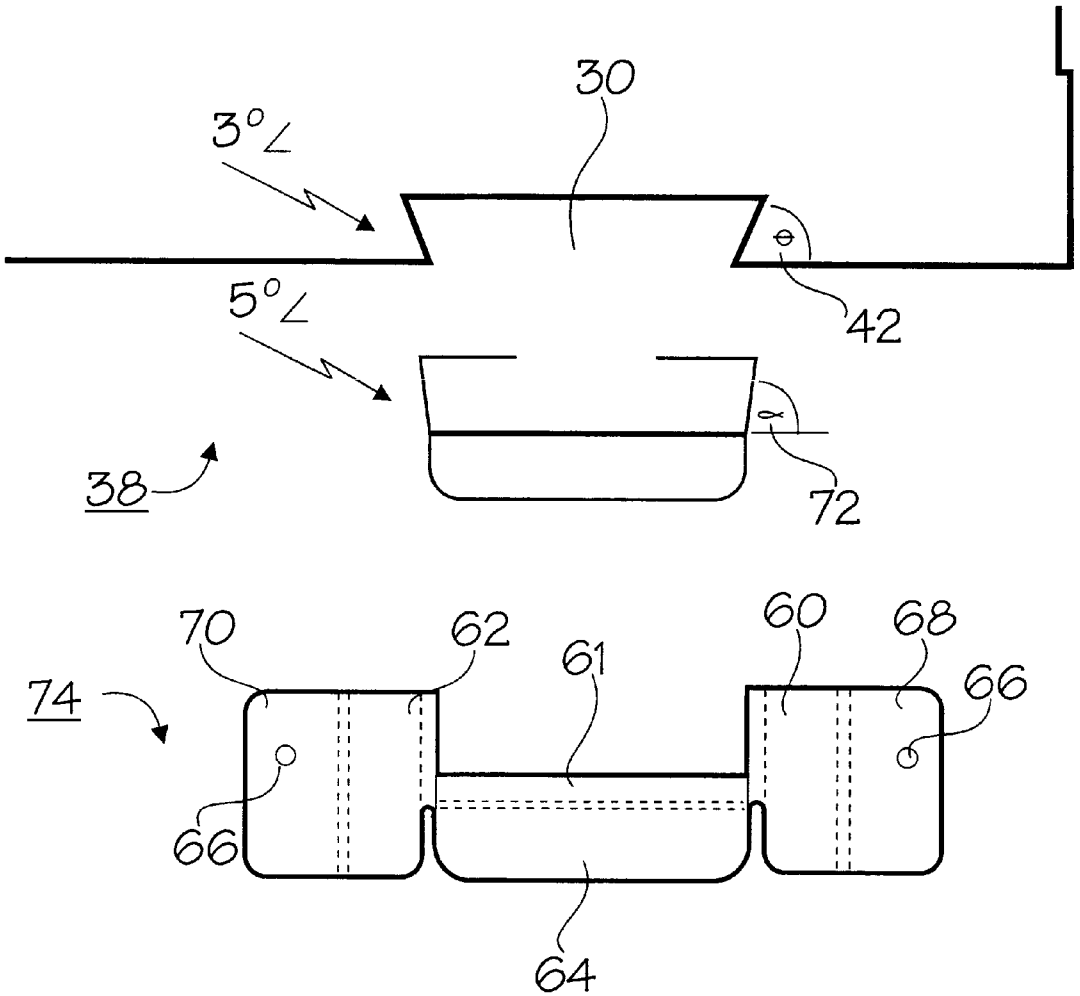
FIG. 6 is a view of the metal plank which would be bent and folded to produce the attachment clip and also showing how the attachment clip cooperates with the metal construction panel.
Figure 7:
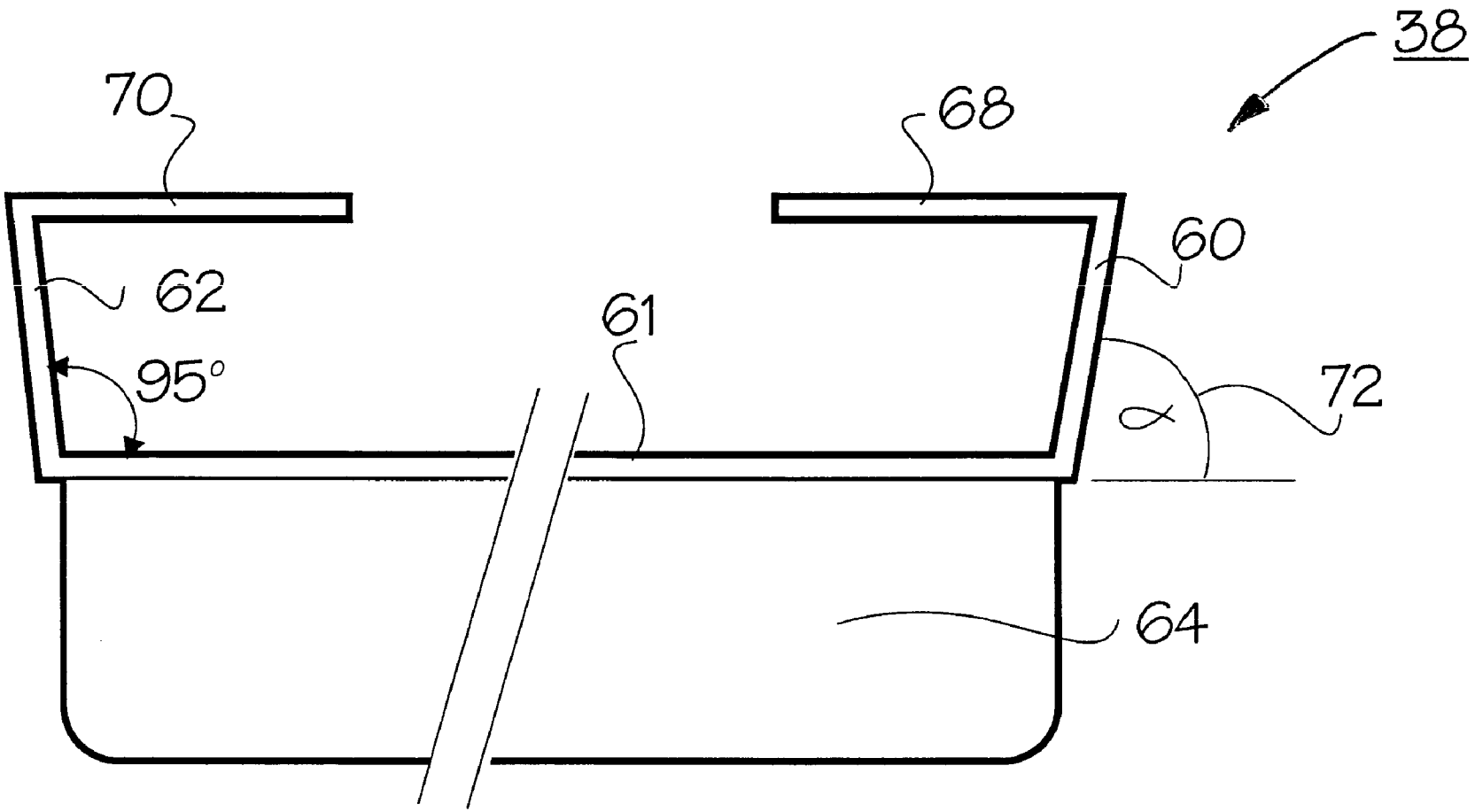
FIG. 7 is a top plan view of the attachment clip.

Referring now to FIGS. 5, 6 and 7 which schematically shows the details of attachment clip 38 shown in situ in FIG. 3, attachment clip 38 includes joining member 61, right tab 60, left tab 62, right wing 68, left wing 70, apertures 66, and attachment lip 64. In practice, attachment clip 3 8 would be made from a sheet of steel and the metal blank prior to bending is shown as clip blank 74 in FIG. 6. The dashed lines in FIG. 6 represent the bend lines in order to fabricate attachment clip 38 into the finished product as shown in FIG. 5. In other words clip bank 74 is bent along the dashed lines to produce attachment clip 38. Attachment clip 38 is so designed such that right tab 60 and left tab 62 can be resiliently flexed to fit and cooperate with dovetail grooves 30 of metal construction panels 20.

In use dovetail grooves 30 and metal construction panels 20 have an angle theta 42 of approximately 87 degrees, whereas right tab 60 makes an angle alpha 72 of approximately 85 degrees. Attachment clip 38 is installed into dovetail groove 30 by deflecting or compressing right tab 60 and left tab 62 such that they fit into dovetail grooves 30 of metal construction panel 20. Attachment clip 38 as shown in FIG. 3 is held in dovetail groove 30 by the biasing force imparted by right tab 60 and left tab 62 onto the inner surfaces of the dovetail grooves 30 of metal construction panel 20. In addition, apertures 66 can be used to instal fastening screws for rigidly attaching and screwing attachment clip 38 to the metal construction panel 20.

Attachment lip 64 extends outwardly from front 22 of metal construction panel 20 and is used for attaching various cladding materials should the user of metal construction panel 20 wish to have an alternative exterior look than the one provided by front 22 of metal construction panel. In this manner by placing numerous attachment clips 38 onto dovetail grooves 30, one can clad the entire exterior surface or the front 22 of metal construction panel 20 and provide for any particular look or architectural appearance the end user desires. For example, brick face, siding, vinyl siding, wood siding, panelling, stucco or any other currently known architectural type finishes can be applied to the front 22 of metal construction panels 20.

Those skilled in the art will appreciate the advantages of the current system namely, one could potentially avoid having to have separate framing and architectural finishing surfaces applied to the exterior of the home, but yet retain the flexibility of adding a particularly architectural surface to the exterior of the home, depending on the end use requirement. Furthermore, using metal construction panels 20, a totally waterproof construction is used due to filling bonding channels 32 with a bonding agent, thereby preventing capillary action of water penetrating through the connection seam between adjacent metal construction panels 20.

The bonding agents can be commercially available exterior caulking compounds including silicone, epoxy or polyester based compounds.

Figure 11:
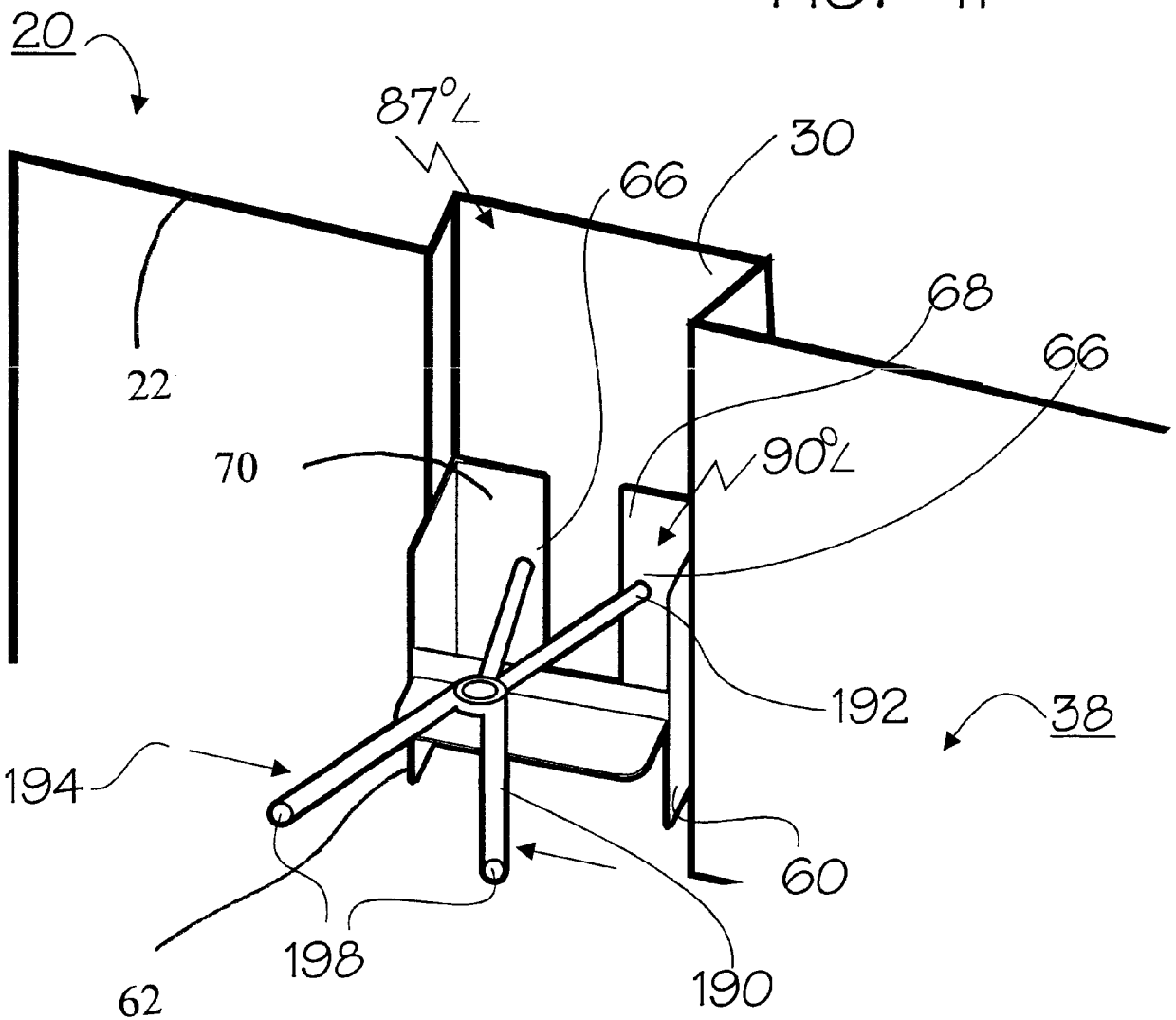
FIG. 11 is a schematic prospective view showing a tool installing an attachment clip into a dove tail groove of a metal construction panel.

Referring now to FIG. 11, which in schematic fashion shows the installation of an attachment clip 38 being installed into a dove tail groove 30. Installation tool 190 as shown in FIG. 11 having tips 192 which are received in apertures 66 of left and right wing 70 and 68 of attachment clip 38. Installation tool 190 is a hand held tool in which handles 198 are compressed in a direction as shown by arrows 194 thereby urging together right and left tab 60 and 62 of attachment clip 38. Right and left tabs of attachment clip 38 are resiliently bias such that by compressing right and left tab 60 and 62, the attachment clip 38 can be urged into dove tail grooves 30 such that right and left wing 68 and 70 lie substantially parallel and adjacent to the back portion of dove tail grooves 30. By removing tips 192 of installation tool 190 from attachment clip 38, leaves attachment clip 138 in position in dove tail groove 30. By reversing the procedure described above the attachment clip 38 can be removed from dove tail groove 30. Note that apertures 66 therefore have two functions, first of all for installing and uninstalling attachment clip 38 from dove tail groove 30 by cooperating with tips 192 of an installation tool 190 and secondly for mechanically fastening attachment clip 38 to metal construction panel 20 by placing screws through apertures 66 into the back of dove tail groove 30 thereby permanently affixing attachment clip 38 to metal construction panel 20.

Strengthening Member

Figure 8:
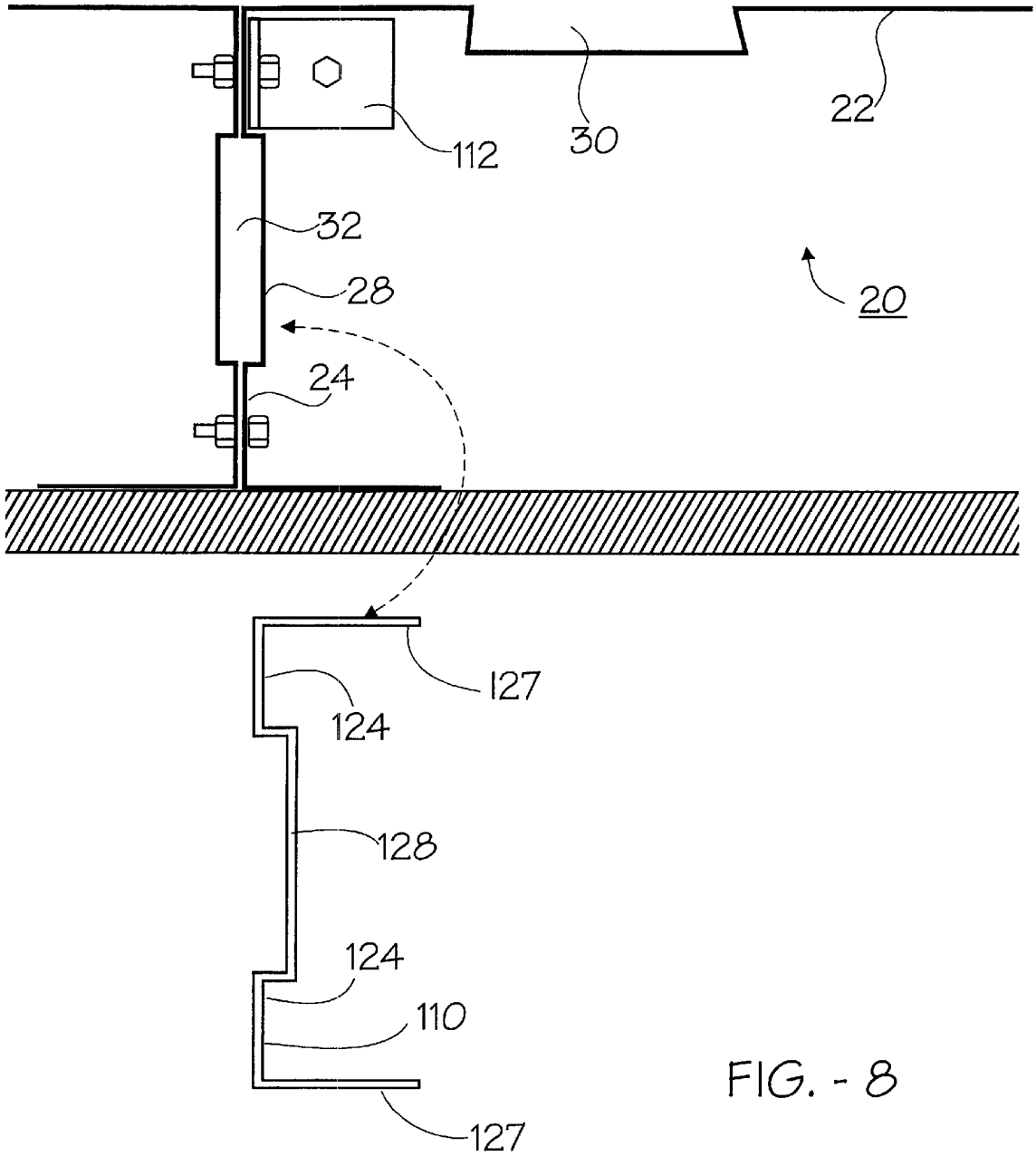
FIG. 8 is a cross-sectional schematic view of two metal construction panels joined together showing how a strengthening member can be used at such a junction.
Figure 9:
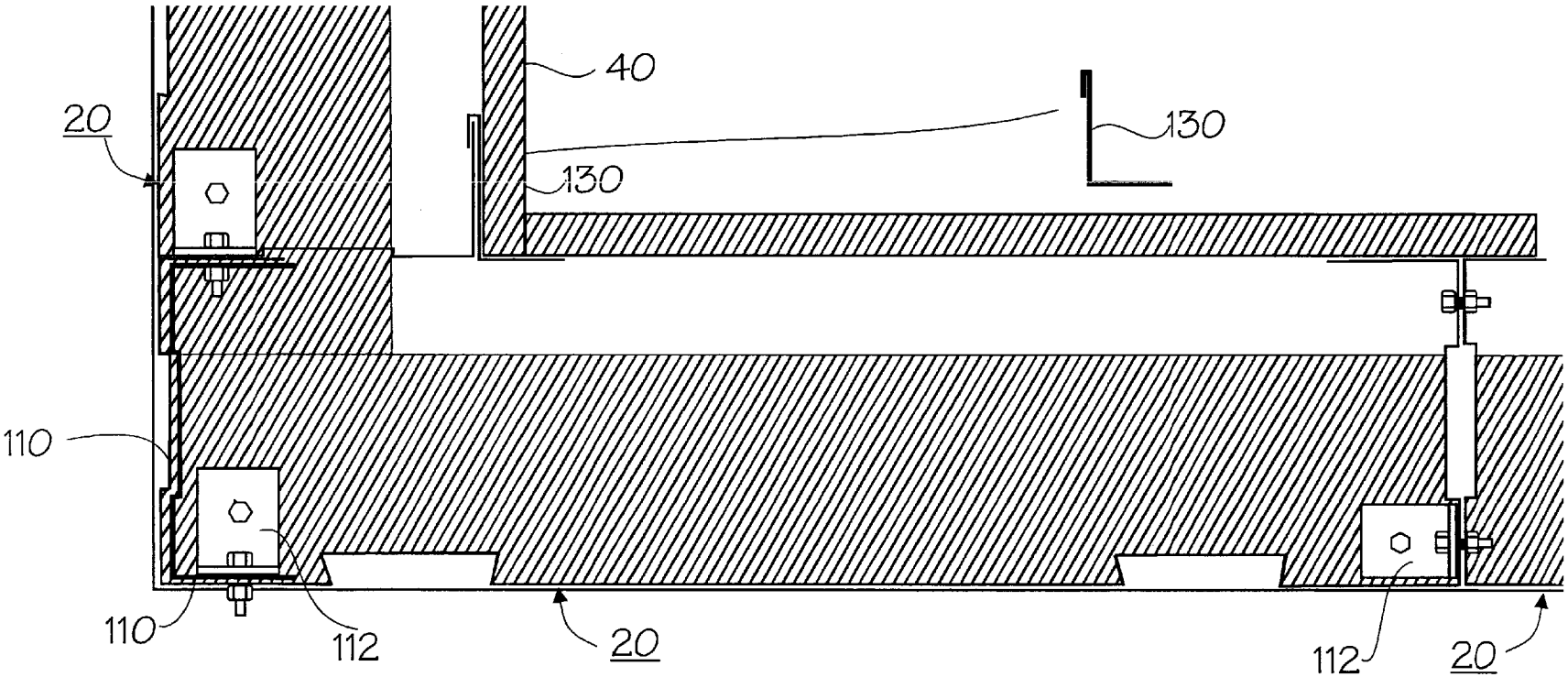
FIG. 9 is a schematic cross-section view of metal construction panels joined together at a comer showing the use and the insertion of a strengthening member at the comer section as well as an attachment flange for fastening wall boards onto the interior comer portion.

Referring now to FIGS. 8 and 9, showing metal construction panels 20 attached together and a strengthening member 110 used to provide additional compressive strength as well as stiffening to the structure for providing enough structural strength for the building to support the roof and other structural weight and also to provide wind and earthquake resistance by the addition of strengthening member 110.

Looking to FIG. 8 which shows in cross-section the profile of strengthening member 110; strengthening member 110 has an end trough section 128, end plate portions 124 and end flange sections 127 and is designed to nest inside and conform with the contour of end plate 24 of metal construction panel 20. Referring now to FIG. 9, strengthening member 110 is shown in situ at a comer section of a metal construction panel 20 and is nested and adjacent to the end plate 24 of construction panel 20. In addition to this the metal construction panel 20 along with the strengthening members 110 are fastened with anchors 112 into concrete at the base and with mechanical fasteners as shown into the metal construction panel 20.

FIG. 9 in particular shows a comer construction possibility by using two metal construction panels 20 to form said comer. The reader will note that no custom section or special section is required in order to form a comer. In order to attach wall board 40 onto the flanges 26 of metal construction panel 20 in a comer as depicted, an attachment flange 130 is required in order to fasten the wall boards 40 together.

Strengthening members 110 are co-extensive with the entire length of metal construction panel 20 and can be placed periodically along the walls formed by metal construction panels 20. For example if extra strength is required, strengthening members 110 can be placed at every end plate 24 of metal construction panel 20 found in a wall. Strengthening members 110 are especially used where the gauge or thickness of the material used to form metal construction panel 20 is too thin to support the structural weight of the building and/or to provide enough stiffness or enough wind resistance. By the use of strengthening members 110, one can form metal construction panel 20 out of a thinner gauge material and yet obtain enough structural strength and stiffness by including additional strengthening members 110 as required. This reduces the overall costs of manufacturing metal constructions panels and allows one to produce the lightest possible weight panel for a given application.

Figure 10:
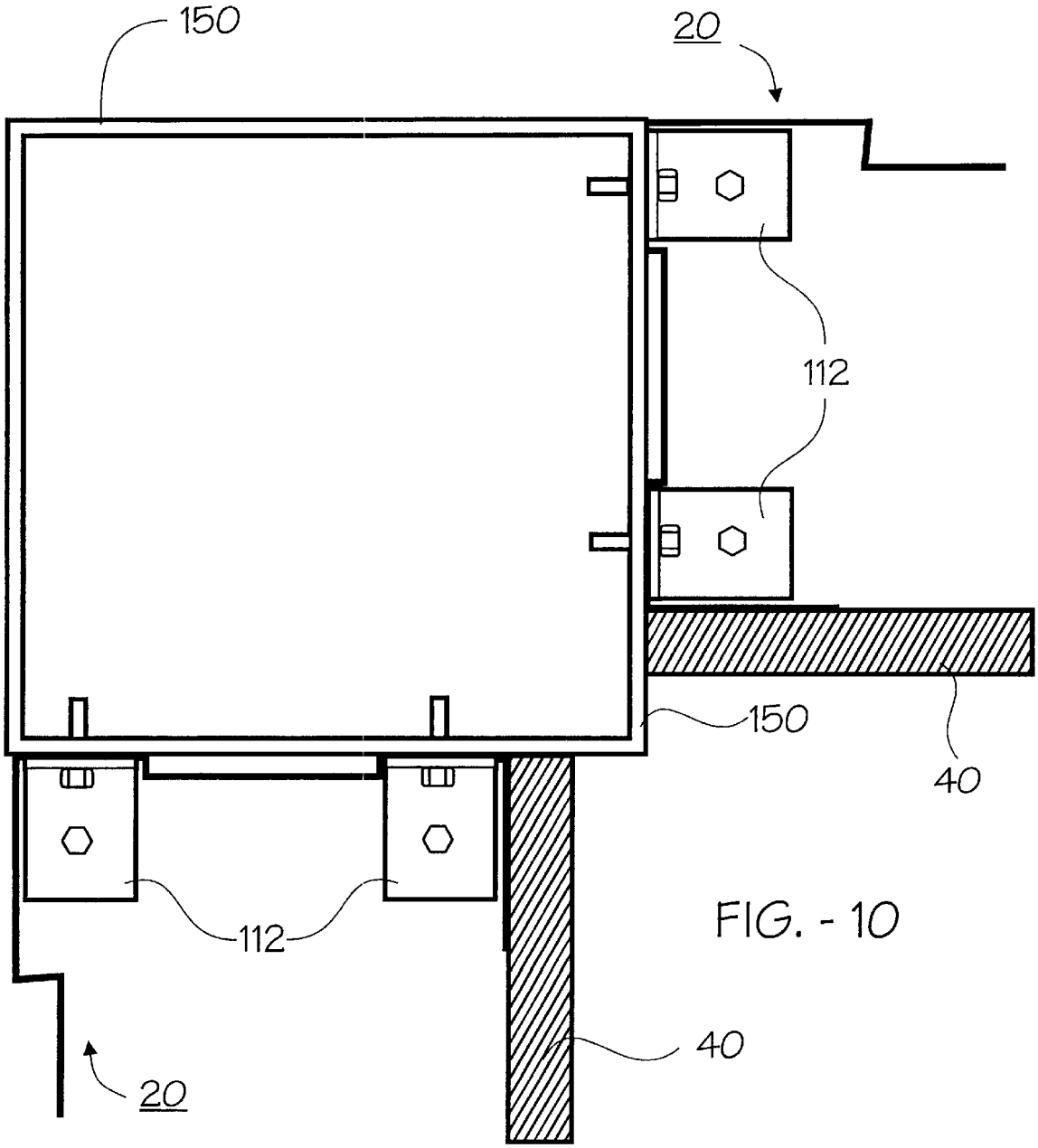
FIG. 10 is a schematic cross-section view of an alternate comer arrangement showing two metal construction panels intersecting at a comer post.

Referring now to FIG. 10 which shows a heavy duty comer construction using a comer post 150 which is a tubular metal comer post construction. As shown in the previous Figures, anchors 112 are used to connect metal construction panel 20 to comer post 150.

Presently Preferred Metal Construction Panel

Figure 12:
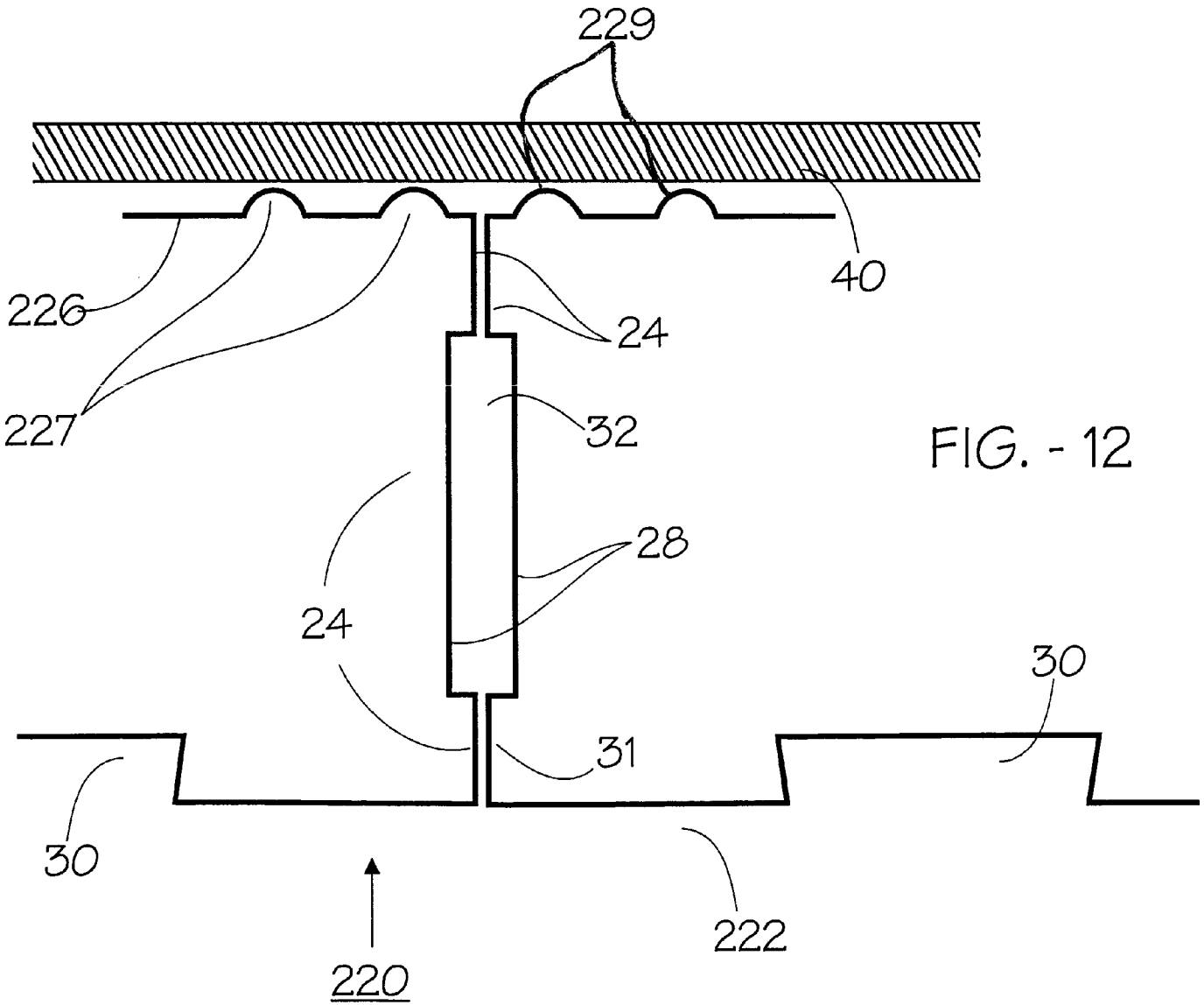
FIG. 12 is a top cross sectional view of two metal construction panels of the presently preferred type showing the modified flange arrangement.

FIG. 12 shows a presently preferred embodiment of metal construction panel 220. In most respects metal construction panel 220 is analogous to metal construction panel 20 in that the front face 222 includes dove tail grooves 30 and also includes end plates 24 having end trough 28 forming a bonding channel 32 between two metal construction panels 220 forming a joint 31. These items remain unchanged and identical to the previously described metal construction panel 20 as shown in FIG. 1. The modification to metal construction panel 220 is the modified flange 226 which includes dimples 227 as shown in FIG. 12. The function of Flange 226 is for mounting wall board and/or other interior finishing materials onto flange 226 as shown in FIG. 12. Wall board 40 as shown in FIG. 12 can either be nailed and/or screwed into any portion of flange 226 in order securely fasten wall board 40 onto flange 226. By providing dimples 227, the wall board 40 makes contact with flange 226 at contact points 229 as shown in FIG. 12. This configuration provides for additional structural strength by increasing the stiffness of metal construction panel 220 by introducing dimples 227 which run along the entire length 102 of metal construction panel 220 and also provide additional compressive strength due to the increased stiffness and cross sectional area of the load bearing member.

The other advantage provided by dimples 227 on flanges 226 is the reduced heat conduction from the front face 222 of metal construction panel through end plate 24 and out through flanges 226 and into the interior of the building through wall board 40. The amount of heat that can be conducted through metal construction panel 220 and into wall board 40 is significantly reduced due to the reduction in the amount of contact surface of flange 226 with wall board 40. Contact between wall board 40 and 226 is limited to contact points 229 as shown in FIG. 12. Dimples 227 can be of different geometries than shown in FIG. 12. As shown in FIG. 12, dimple 227 are crescent shaped or half moons or half circles in shape, however, they also may be squared off, triangular, V-shaped, and/or any other shape which minimizes the contact between wall board 40 and flange 226.

It should be apparent to persons skilled in the arts that various modifications and adaptation of this structure described above are possible without departure from the spirit of the invention the scope of which defined in the appended claim.

I claim:

1. An elongated metal construction panel for use in forming a portion of the vertical walls of a building structure by being fastened to an identical adjacent panel, the metal construction panel comprising:

(a) a front portion co-extensive with the length of the panel;

(b) end plates co-extensive with the length of the panel disposed substantially normal to said front portion and extending from distal ends of said front portion, said end plates defining the depth of said panel;

(c) flanges co-extensive with the length of the panel and extending inwardly from distal ends of said end plate, wherein said flanges are spaced from and parallel to said front portion; and (d) wherein said end plates include end troughs co-extensive with the length of the panel such that when metal construction panels are place adjacent each other by bringing into contact said end plates, said end troughs form a bonding channel adapted and sized for pouring bonding agents therein thereby securely fastening adjacent panels together and also waterproofing the joint between said end plates;

(e) wherein said flanges include stiffening means for increasing stiffness and load carrying ability of said panel; and (f) wherein said stiffening means includes crescent shaped dimples defined in said flange, said dimples co-extensive with the length of the panel.

2. The metal construction panel claimed in claim 1, wherein said end troughs including a fluted section having a U shaped profile being co-extensive with the length of the panel.

3. The metal construction panel claimed in claim 2, wherein the width of said front portion is at least 3 times the depth of said end plate.

4. The metal construction panel claimed in claim 3, wherein the width of said front portion is preferably 4 times the depth of said end plate.

5. The metal construction panel claimed in claim 4, wherein the depth of said end plate being at least 3½ inches.

6. The metal construction panel claimed in claim 1, wherein the front portion includes female dovetail grooves co-extensive with the length of the panel and adapted to co-operate with an attachment clip for fastening articles to said attachment clip.

7. The metal construction panel claimed in claim 6, wherein said dovetail grooves define fluted surfaces disposed at an angle theta less than 90°.

8. The metal construction panel claimed in claim 6, wherein said angle theta is preferably 87°.

9. The metal construction panel claimed in claim 6, wherein said attachment clip defines male dovetail tabs cooperating with said female dovetail grooves to hold said clip within said dovetail grooves, whereby said tabs are joined together in spaced apart relationship by a joining member.

10. The metal construction panel claimed in claim 9, wherein said tabs are resiliently biased such that said tabs are compressed for placing said tabs within said female dovetail grooves and upon release said resiliently biased tabs hold said attachment clip within said female dovetail grooves.

11. The metal construction panel claimed in claim 10, wherein said attachment clip further comprises wings extending from said tabs and oriented substantially parallel and adjacent to said front portion for installation and fastening of said clip to said panel.

12. The metal construction panel claimed in claim 11, wherein said attachment clip further comprises apertures defined in said wings, wherein said apertures are adapted for cooperating with a compressing means for compressing said tabs and said apertures also for receiving fasteners there through for fastening said clip to said panel.

13. The metal construction panel claimed in claim 9, wherein said attachment clip further comprises an attachment lip rigidly connected to said joining member for fastening articles thereto.

14. The metal construction panel claimed in claim 6, wherein said attachment clip is adapted for fastening vinyl siding thereto.

15. An elongated metal construction panel for use in forming a portion of the vertical walls of a building structure by being fastened to an identical adjacent panel, the metal construction panel comprising:

(a) a front portion co-extensive with the length of the panel;

(b) end plates co-extensive with the length of the panel disposed substantially normal to said front portion and extending from distal ends of said front portion, said end plates defining the depth of said panel;

(c) flanges co-extensive with the length of the panel and extending inwardly from distal ends of said end plate, wherein said flanges are spaced from and parallel to said front portion; and (d) strengthening means, securely fastened adjacent to at least one of said end plates of said metal construction panel for reinforcing and stiffening said metal construction panel.

16. The metal construction panel claimed in claim 15, wherein said strengthening means includes a strengthening member co-extensive with the length of the panel and having a profile adapted to nest together and adjacent to said end plate portion of said metal construction panel.

17. The metal construction panel claimed in claim 16, wherein said strengthening member includes an end plate portion and an end trough portion adapted and sized to nest together and lie adjacent with said end plate and said end trough of said panel.

18. The metal construction panel claimed in claim 17, wherein said strengthening member includes an end flange portion adapted and sized to nest together and lie adjacent with said end flange said panel.

* * * * *